US009927119B2

(12) United States Patent
Cao et al.

(10) Patent No.: US 9,927,119 B2
(45) Date of Patent: Mar. 27, 2018

(54) DUAL-BED SYSTEM FOR PREVENTING BOILER HEATING SURFACE FROM BEING CONTAMINATED

(71) Applicant: DONGFANG ELECTRIC CORPORATION, Chengdu, Sichuan (CN)

(72) Inventors: Liyong Cao, Sichuan (CN); Wei Fan, Sichuan (CN); Qi Du, Sichuan (CN); Pan Guo, Sichuan (CN); Zhengning Liu, Sichuan (CN); Yuan Zhang, Sichuan (CN); Chunfei Zhang, Sichuan (CN); Jiang Liu, Sichuan (CN); Chunyun Hu, Sichuan (CN); Xiaoguang Zhang, Sichuan (CN); Yu Lei, Sichuan (CN)

(73) Assignee: DONGFANG ELECTRIC CORPORATION (CN)

( * ) Notice: Subject to any disclaimer, the term of this patent is extended or adjusted under 35 U.S.C. 154(b) by 417 days.

(21) Appl. No.: 14/425,678

(22) PCT Filed: Sep. 25, 2013

(86) PCT No.: PCT/CN2013/084224
§ 371 (c)(1),
(2) Date: Mar. 4, 2015

(87) PCT Pub. No.: WO2014/048328
PCT Pub. Date: Apr. 3, 2014

(65) Prior Publication Data

US 2015/0226423 A1 Aug. 13, 2015

(30) Foreign Application Priority Data

Sep. 25, 2012 (CN) ..... 2012 1 0360104

(51) Int. Cl.
*F23C 10/10* (2006.01)
*F23C 10/00* (2006.01)
(Continued)

(52) U.S. Cl.
CPC ..... *F23C 10/10* (2013.01); *F22B 37/025* (2013.01); *F23C 6/02* (2013.01); *F23C 10/005* (2013.01);
(Continued)

(58) Field of Classification Search
CPC ..... F23C 10/10; F23C 10/22; F23C 10/005; F23C 10/32; F23C 6/02; F23C 10/26;
(Continued)

(56) References Cited

FOREIGN PATENT DOCUMENTS

CN 1030291 A 1/1989
CN 2376579 5/2000
(Continued)

OTHER PUBLICATIONS

International Search Report for International Patent Application No. PCT/CN2013/084224, dated Jan. 2, 2014.

*Primary Examiner* — Alfred Basichas
(74) *Attorney, Agent, or Firm* — McAndrews, Held & Malloy, Ltd.

(57) ABSTRACT

A dual-bed system for preventing a boiler heating surface from being contaminated comprises a fluidized bed, a cyclone separator, a coal ash distributor, an ash-coal mixer, a lower pyrolysis bed, a return feeder and a cleaner, wherein the cyclone separator is connected with the upper lateral side of the fluidized bed; the inlet end of the coal ash distributor; the two outlets of the coal ash distributor are respectively connected with the inlet of the return feeder and the inlet of the ash-coal mixer; the outlet of the ash-coal mixer is connected with the inlet of the lower pyrolysis bed; the return feeder close to the lower lateral side of the fluidized
(Continued)

bed is connected with the inlet on the lower lateral side of the fluidized bed; and the outlet of the cleaner is connected with the inlet on the lower lateral side of the fluidized bed.

4 Claims, 1 Drawing Sheet

(51) Int. Cl.

| | |
|---|---|
| ***F23C 10/32*** | (2006.01) |
| ***F22B 37/02*** | (2006.01) |
| ***F23C 10/22*** | (2006.01) |
| ***F23C 10/26*** | (2006.01) |
| ***F23C 6/02*** | (2006.01) |

(52) U.S. Cl.
CPC ..... *F23C 10/22* (2013.01); *F23C 10/26* (2013.01); *F23C 10/32* (2013.01); *F23C 2900/10005* (2013.01); *F23J 2215/60* (2013.01); *F23K 2201/505* (2013.01)

(58) Field of Classification Search
CPC ..... F23C 2900/10005; F22B 37/025; F23J 15/02; F23J 1/02; F23J 2215/60; F23K 2201/505
See application file for complete search history.

(56) References Cited

FOREIGN PATENT DOCUMENTS

| | | | |
|---|---|---|---|
| CN | 2527866 | Y | 12/2002 |
| CN | 1667086 | | 9/2005 |
| CN | 1727750 | | 2/2006 |
| CN | 1754945 | | 4/2006 |
| CN | 1804460 | A | 7/2006 |
| CN | 200996005 | | 12/2007 |
| CN | 101353582 | | 1/2009 |
| CN | 201462777 | U | 5/2010 |
| CN | 102829474 | | 12/2012 |
| CN | 202813359 | | 3/2013 |
| WO | 2011060556 | | 5/2011 |

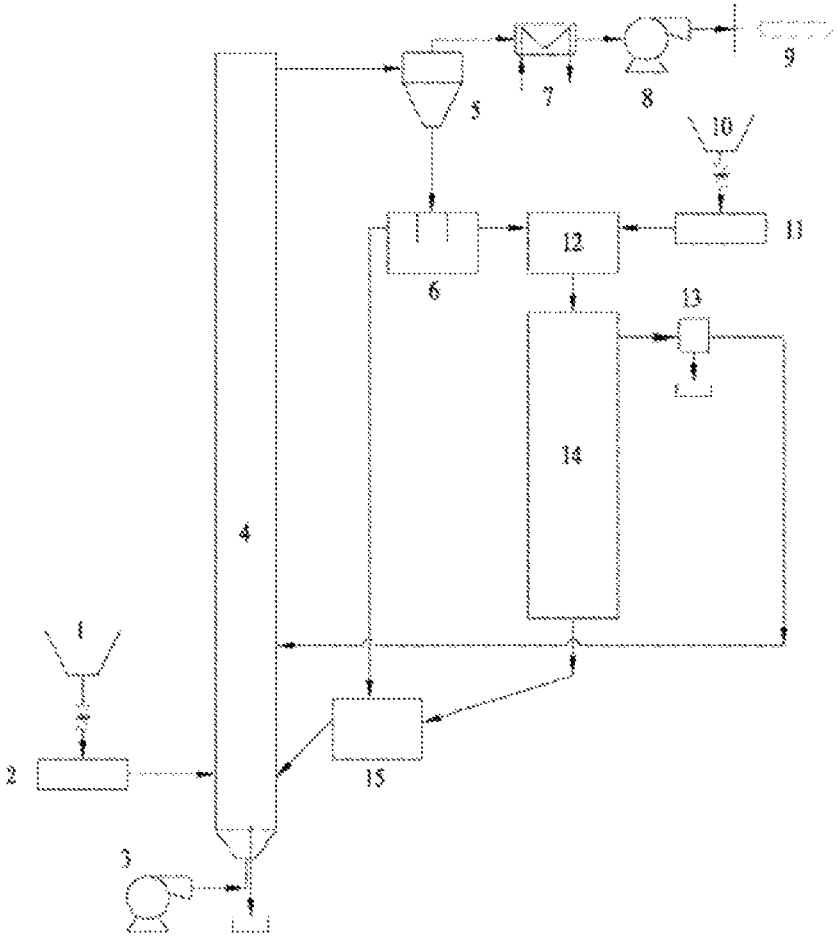
1
2
3
4
5
6
7
8
9
10
11
12
13
14
15

DUAL-BED SYSTEM FOR PREVENTING BOILER HEATING SURFACE FROM BEING CONTAMINATED

CROSS-REFERENCE TO RELATED APPLICATIONS/INCORPORATION BY REFERENCE

This application is a 371 of International Patent Application No. PCT/CN2013/084224, filed Sep. 25, 2013, entitled "DUAL-BED SYSTEM TO PREVENT THE POLLUTION OF BOILER HEATING SURFACE", which claims priority to Chinese Patent Application No. 201210360104.4, filed Sep. 25, 2012, entitled "DOUBLE-BED SYSTEM FOR PREVENTING HEATING SURFACE OF BOILER FROM BEING CONTAMINATED". The above-identified applications are hereby incorporated herein by reference in their entirety.

TECHNICAL FIELD OF THE INVENTION

The disclosure relates to a technology related to relieving the contamination to a boiler heating surface and more particularly to a dual-bed system for preventing a boiler heating surface from being contaminated.

BACKGROUND OF THE INVENTION

Thermal power generation plays a major role in China's domestic power generation industry, the installed thermal power capacity being higher than 70%. The use of low-quality low-grade coals as power coals by most of thermal power plants causes the slagging on the water wall of a boiler furnace and the slagging and fouling on a convective heat-absorbing surface, which is one of the major problems affecting the normal running of the boiler in a power station. The slagging and fouling will reduce the heat transfer efficiency of the boiler, lower the output of the boiler and impair the operation security of a device, and a severe slagging may even lead to the flameout of a furnace, a pipe bursting, an unscheduled boiler shutdown and other serious accidents.

To avoid the various problems caused by fouling and slagging, a lot of research has been made on the mechanism of fouling and slagging by scholars at home and abroad and a plurality of slagging determination indexes have been proposed by the scholars which confront many limitations in the actual application and therefore only serve for a preliminary determination but cannot fundamentally eliminate the damages caused by contamination to a boiler. A method is also proposed to regulate the combustion in the furnace of a boiler to control the temperature in the furnace to relieve the slagging problem of the boiler, this method, which cannot be operated conveniently in the actual application, is not popularized. For a high-alkalinity coal, the alkali metals volatilizing from the high-alkalinity coal are likely to condense on a boiler heating surface to form a bottom deposit which exists mainly in the form NaCl or $Na_2SO_4$. After volatilizing in a high-temperature environment, the foregoing components are likely to coagulate on a convective heat-absorbing surface to form a sintered or adhered ash deposit, the continuous absorption of the deposit to fly ash causes varying degrees of contamination to the convective heat-absorbing surface, moreover, the contaminants which cannot be removed using a soot blower reduce the heat transfer capability of the heat-absorbing surface, increase the temperature of the smoke discharged from the boiler and finally greatly reduce the output of the furnace of the boiler to shut down the boiler.

At present, there is a domestic lack of the engineering operation experience on the use of the combustion of a high-alkalinity coal, only several power plants in Xinjiang are studying the problem of the contamination caused by the combustion of a high-alkalinity coal but have not developed any effective high-alkalinity coal utilization method. The contamination problem can only be relieved through non-local coal blended combustion; non-local coal blended combustion is actually a method of reducing the relative content of the alkali metals contained in a raw coal by adding other low-alkalinity metal coals. The proportion of the high-alkalinity coal blended for combustion should be below 30%. When the proportion of the high-alkalinity coal blended for combustion is increased, the serious contamination caused by the ash deposit to the convective heat-absorbing surface generates a smoke passage, and the wash-out of smoke causes the leakage of a high temperature reheater and a high temperature superheater. As high-alkalinity coals are mainly used by electric power stations near coal-mines in Xinjiang, a high amount of non-local coals is needed for blended combustion, thus, this combustion mode is usually limited by transportation conditions and is therefore significantly increased in running cost. A platen superheater is arranged in the pulverized coal boiler of existing large power stations to reduce the outlet temperature of the furnace of the boiler and decrease molten slag, however, as relatively low in melting point, some alkali metal salts in smoke are still slagged when flowing through a convective heat-absorbing surface, the slagging phenomenon gets specifically worse in the combustion of Zhundong coal containing high-alkalinity metals. Advantaged in wide fuel applicability range, high combustion efficiency and few polluting emissions, circulating fluidized bed boiler has been rapidly developed in the past dozen years and widely commercially applied in the field of power station boilers. When a circulating fluidized bed burns a high-alkalinity coal as a power coal, the contamination to a convective heat-absorbing surface is also severe. The existence of slagging and fouling limits the large-scale efficient utilization of high-alkalinity coals and consequentially restricts the utilization efficiency of the energies of China.

SUMMARY OF THE INVENTION

To address the problem of the contamination to the convective heat-absorbing surface of existing power station boiler, the disclosure provides a dual-bed system for preventing a boiler heating surface from being contaminated which is simply structured to guarantee the full heat exchange of a boiler heating surface, stabilize the output of a boiler, prevent the temperature of the convective heat-absorbing surface from being overhigh for contamination to greatly reduce the probability of the occurrence of a pipe bursting accident and realize the large-scale pure combustion of a high-alkalinity coal.

To address the technical problem above, the technical solution of the disclosure is as follows:

a dual-bed system for preventing a boiler heating surface from being contaminated comprises a fluidized bed, a cyclone separator, a coal ash distributor, an ash-coal mixer, a lower pyrolysis bed, a return feeder and a cleaner, wherein the cyclone separator is connected with the upper lateral side of the fluidized bed so that the high-temperature coal ash from the fluidized fed enters the cyclone separator, the outlet end of the cyclone separator is connected with the inlet end of the coal ash distributor which is provided with two outlets one of which is connected with the inlet of the return feeder and the other one of which is connected with the inlet of the ash-coal mixer; the outlet of the ash-coal mixer is connected with the inlet of the lower pyrolysis bed; the lower pyrolysis bed is provided with two outlets one of which is connected with the inlet of the return feeder and the other one of which is connected with the inlet of the cleaner; the return feeder close to the lower lateral side of the fluidized bed is connected with the inlet on the lower lateral side of the fluidized bed; and the outlet of the cleaner is connected with the inlet on the lower lateral side of the fluidized bed.

A heat exchanger is arranged behind the cyclone separator and connected with a draught fan which is connected with a chimney.

Coal is fed into the ash-coal mixer via a feeder which is connected with the ash-coal mixer, and the feeder is provided with a coal hopper.

The working process of the system is as follows:

the upper end of the fluidized bed extends into the cyclone separator, the high-temperature coal ash of the cyclone separator enters the coal ash distributor to feed part of the high-temperature coal ash into the return feeder and the other part of the high-temperature coal ash into the ash-coal mixer, meanwhile, raw coal is fed into the ash-coal mixer through a coal hopper and the feeder to be mixed with the high-temperature coal ash in the ash-coal mixer; the mixture of the coal and the coal ash enters the lower pyrolysis bed to be pyrolyzed, the pyrolyzed coal and coal ash enters the return feeder; the high-temperature coal ash not passing the lower pyrolysis bed and the pyrolyzed and mixed coal and coal ash are both fed into the furnace chamber of the fluidized bed to be combusted, wherein the pyrolysis gas produced by the lower pyrolysis bed first passes the cleaner to be sodium-removed and then enters the fluidized bed to be combusted.

The working principle of the system is as follows:

in a circulating fluidized bed boiler burning high-alkalinity coals, raw coal is pyrolyzed by means of circulating hot ash before entering the furnace chamber of a boiler so as to make full use of energies, in this way, not only volatilizable Na can be removed but also the content of the Na contained in the coal is reduced, thus lowering the content of the active Na in smoke and reducing the amount of the sodium salts adhered and deposited on the convective heat-absorbing surface of the boiler and consequentially reducing the contamination to the convective heat-absorbing surface.

The disclosure has the following beneficial effects:

(1) by removing volatilizable Na through pyrolysis, the disclosure lowers the content of the Na element contained in the coal, reduces the contamination to the convective heat-absorbing surface of the boiler, improves the heat exchange efficiency of a heat exchange surface and stabilizes the output of the boiler;

(2) by pyrolyzing high-alkalinity metal coals using the circulating hot ash of a boiler, the disclosure solves the gas-solid separation needed in gas heating and saves the high cost caused by the current utilization of high-alkalinity coals merely through blended combustion;

(3) the disclosure realizes the large-scale pure combustion of a high-alkalinity coal to increase the profit of power plants without modifying the design of existing boilers significantly;

(4) as the pyrolysis gas resulting from a pyrolysis is fed into a fluidized bed again to be combusted, the problem is avoided that pyrolyzed tar contains much ash and is difficult to process, and the output of a boiler is improved;

(5) compared with a method of eliminating the contamination caused by the combustion of a high-alkalinity coal such as Zhundong coal by blending low-alkalinity coals for combustion, the disclosure solves problems such as the transportation cost of pulverized coal needed for blended combustion.

BRIEF DESCRIPTION OF DRAWINGS

FIG. 1 is a schematic diagram illustrating the structure of a system according to the disclosure.

Explanation of reference signs in FIG. 1: 1 coal hopper; 2 feeder; 3 blower; 4 fluidized bed; 5: cyclone separator; 6 coal ash distributor; 7 heat exchanger; 8 draught fan; 9 chimney; 10 coal hopper; 11 feeder; 12 ash-coal mixer; 13 cleaner; 14 lower pyrolysis bed; 15 return feeder.

DETAILED DESCRIPTION OF THE EMBODIMENTS

As shown in FIG. 1, a dual-bed system for preventing a boiler heating surface from being contaminated comprises a fluidized bed 4, a cyclone separator 5, a coal ash distributor 6, an ash-coal mixer 12, a lower pyrolysis bed 14, a return feeder 15 and a cleaner 13. The cyclone separator 5 is connected with the upper lateral side of the fluidized bed 4 so that the high-temperature coal ash from the fluidized bed 4 enters the cyclone separator 5, and the outlet end of the cyclone separator 5 is connected with the inlet end of the coal ash distributor 6 which is provided with two outlets one of which is connected with the inlet of the return feeder 15 and the other one of which is connected with the inlet of the ash-coal mixer 12; the outlet of the ash-coal mixer 12 is connected with the inlet of the lower pyrolysis bed 14; the lower pyrolysis bed 14 is provided with two outlets one of which is connected with the inlet of the return feeder 15 and the other one of which is connected with the inlet of the cleaner 13; the outlet of the external bed is connected with the inlet of the return feeder 15; the return feeder 15 close to the lower lateral side of the fluidized bed 4 is connected with the inlet on the lower lateral side of the fluidized bed 4; and the outlet of the cleaner 13 is connected with the inlet on the lower lateral side of the fluidized bed 4.

A heat exchanger 7 is arranged behind the cyclone separator 5 and connected with a draught fan 8 which is connected with a chimney 9.

Coal is fed into the ash-coal mixer 12 via a feeder 11 which is connected with the ash-coal mixer 12, and the feeder 11 is provided with a coal hopper 10.

The cleaner 13 may be a filter.

The working process of the whole system is as follows:

As shown in FIG. 1, in the initial operation phase of a boiler, a non-local coal may be blended or external ash may be added through the coal hopper 1 and the feeder 2 until the boiler runs normally and generates a given amount of coal ash, then the coal ash generated by the boiler is used to pyrolyze the raw coal from the coal hopper 10 and the feeder 11. The feeding of the coal using the coal hopper 1 and the feeder 2 can be stopped after the lower pyrolysis bed 14 runs normally. When the boiler runs normally, the semi-cake resulting from the pyrolysis is combusted with the air from the blower 3 in the furnace chamber of the fluidized bed 4, and the resulting coal ash and smoke enters the separator 5 to be separated. After the temperature of the separated smoke is reduced by the heat exchanger 7, the smoke is discharged into the air by the draught fan 8 through the chimney 9. The separated coal ash enters the distributor 6 to be divided into two parts according to the need of the lower pyrolysis furnace 14, one part of the coal ash is directly returned to the furnace of the fluidized bed 4 by the return feeder 15 while the other part of the coal ash enters the mixer 12 to be mixed with the high-alkalinity coal from the coal hopper 10 and the feeder 11. The hot ash and the high-alkalinity coal uniformly mixed in the mixer 12 enter the lower pyrolysis bed 14 to be pyrolyzed; after the Na contained in the gas resulting from the pyrolysis is removed by the cleaner 13, the gas enters the fluidized bed 4 to be combusted, and the pyrolyzed hot ash and high-alkalinity semi-cake enters the return feeder 15 to be combusted in the furnace chamber of the fluidized bed 4. The slag discharging of the boiler is carried out on the bottom of the fluidized bed 4. Most of volatilizable sodium is removed after the high-alkalinity coal is pyrolyzed in the lower pyrolysis furnace 14, as the sodium content of high-alkalinity coal is reduced, the content of the active sodium contained in the smoke resulting from the combustion carried out in the furnace chamber of the fluidized bed 4 is greatly reduced, thus there is almost no contamination caused when the smoke passes the subsequent heat-absorbing surface.

The invention claimed is:

1. A dual-bed system for preventing a boiler heating surface from being contaminated comprising: a fluidized bed, a cyclone separator, a coal ash distributor, an ash-coal mixer, a lower pyrolysis bed, a return feeder and a cleaner, wherein the cyclone separator is connected with the upper lateral side of the fluidized bed so that the high-temperature coal ash from the fluidized bed enters the cyclone separator, the outlet end of the cyclone separator is connected with the inlet end of the coal ash distributor;

the coal ash distributor is provided with two outlets one of which is connected with the inlet of the return feeder and the other one of which is connected with the inlet of the ash-coal mixer;

the outlet of the ash-coal mixer is connected with the inlet of the lower pyrolysis bed;

the lower pyrolysis bed is provided with two outlets one of which is connected with the inlet of the return feeder and the other one of which is connected with the inlet of the cleaner;

the return feeder close to the lower lateral side of the fluidized bed is connected with the inlet on the lower lateral side of the fluidized bed; and the outlet of the cleaner is connected with the inlet on the lower lateral side of the fluidized bed.

2. The system according to claim 1, wherein a heat exchanger is arranged behind the cyclone separator and connected with a draught fan which is connected with a chimney.

3. The system according to claim 1, wherein coal is fed into the ash-coal mixer via a feeder which is connected with the ash-coal mixer, and a coal hopper is arranged above the feeder.

4. The system according to claim 1, wherein the upper end of the fluidized bed extends into the cyclone separator, the high-temperature coal ash of the cyclone separator enters the coal ash distributor to feed part of the high-temperature coal ash into the return feeder and the other part of the high-temperature coal ash into the ash-coal mixer, meanwhile, raw coal is fed into the ash-coal mixer) through a coal hopper and the feeder to be mixed with the high-temperature coal ash in the ash-coal mixer;

the mixture of the coal and the coal ash enters the lower pyrolysis bed to be pyrolyzed, the pyrolyzed high-alkalinity semi-coke and coal ash enters the return feeder; and the high-temperature coal ash not passing the lower pyrolysis bed and the pyrolyzed and mixed high-alkalinity semi-coke and coal ash are both fed into the furnace chamber of the boiler of the fluidized bed through the return feeder to be combusted, wherein the pyrolysis gas obtained by the lower pyrolysis bed first passes the cleaner to be sodium-removed and then enters the fluidized bed to be combusted.

* * * * *